US005748756A

United States Patent [19]

Leal et al.

[11] Patent Number: 5,748,756

[45] Date of Patent: May 5, 1998

[54] ENTERTAINMENT SYSTEM WITH SOUND STORAGE CARTRIDGE AND PLAYBACK DEVICE

[75] Inventors: Horacio Leal, Miami; Israel Kaganas, Aventura, both of Fla.

[73] Assignee: TLC Industries Inc., Hallandale, Fla.

[21] Appl. No.: 733,715

[22] Filed: Oct. 16, 1996

[51] Int. Cl.[6] ..... G10D 5/00

[52] U.S. Cl. ..... 381/118; 381/61; 381/124

[58] Field of Search ..... 381/118, 124, 381/61; 84/601, 602

[56] References Cited

U.S. PATENT DOCUMENTS 4,607,351 8/1986 Gerber et al. ..... 365/228

4,630,301 12/1986 Hohl et al. ..... 381/63

*Primary Examiner*—Forester W. Isen

*Attorney, Agent, or Firm*—Robert M. Downey, P.A.

[57] ABSTRACT

An entertainment system includes a cartridge provided with read-only memory (ROM) for storing digital data therein in accordance with predetermined addresses, and a player device structured to receive the cartridge therein. The player device is provided with an address register communicating with the ROM for identifying and activating one of the addresses, a digital to analog converter for converting the digital data to analog signals, a data bus for delivering the digital data from the activated address of the ROM to the digital to analog converter, an amplifier for receiving and amplifying the analog signals prior to delivery to a sound projecting device, such as speakers, and a timing circuit for activating the address register and digital to analog converter in alternating sequence.

3 Claims, 2 Drawing Sheets

ENTERTAINMENT SYSTEM WITH SOUND STORAGE CARTRIDGE AND PLAYBACK DEVICE

BACKGROUND OF THE INVENTION

1. Field of the Invention

The present invention relates to the field of sound storage and playback systems, and more particularly, to audio systems comprising a cartridge and playback device, wherein digital audio data is stored on ROM in the cartridge and converted to analog signals by the playback device for delivery to speaker means.

2. Description of the Related Art

There have been numerous entertainment devices developed in the related art which employ the use of a cartridge containing ROM for receipt within a playback device. Such systems have primarily been developed in the field of multimedia entertainment for playing video games on a TV monitor or handheld device. The various entertainment devices in the related art require the use of a central processing unit (CPU) to execute programs stored on ROM and to control the various components of the system. Examples of systems in the related art are disclosed in the U.S. patents to Carter, U.S. Pat. No. 5,556,107; Nagano, et al., U.S. Pat. No. 5,556,108; and Okada, U.S. Pat. No. 5,426,763.

A central processor unit (CPU) is needed in many of the systems in the related art, especially multimedia-type entertainment systems combining motion video with audio. The need for a microprocessor substantially increases the cost and complexity of the system and also increases power consumption which shortens battery life. Further, the use of a microprocessor or a microcomputer requires development and support of microcode or firmware and the installation and storage of microcode. Further, a microprocessor requires a crystal oscillator which further increases the cost.

Notwithstanding the developments in the related art, there still exists a need for a low cost, highly effective and efficient entertainment system for storage and playback of audio, including music and narration, which eliminates the need for a central processing unit, and microcode (software) and firmware.

SUMMARY OF THE INVENTION

The present invention utilizes a solid state cartridge as a storage media to eliminate the mechanical components that must be present in both tape and disc systems. The solid state media cartridge is designed as a plug-in component for receipt within a playback device. The cartridge contains read-only memory (ROM) for storage of recorded audio data (music and/or narration) in accordance with predetermined addresses. The playback device includes a slot in a front panel thereof to accommodate receipt of the cartridge. The playback device is designed to receive the cartridge so as to allow insertion in only one direction, thereby ensuring correct polarization. The playback device further provides for a combination on/off switch, volume level control, a reset control, and a pause control.

Digital audio data is sequentially retrieved from the addresses on the ROM using an address register. A timing circuit enables and disables the address register and a digital to analog converter, in alternating sequence, so that the retrieved digital data is delivered to the digital to analog converter in the playback device. The digital data is converted to analog signals and amplified for delivery to speaker means, earphones, or other sound projecting equipment.

With the foregoing in mind, it is a primary object of the present invention to provide an entertainment system including an audio storage cartridge and playback device which does not require a microprocessor or microcomputer, thereby reducing the cost and complexity of the system and reducing power consumption, thereby extending battery life.

It is a further object of the present invention to provide an entertainment system for storage and playback of recorded audio signals which does not require microcode or firmware.

It is still a further object of the present invention to provide an entertainment system wherein all of the electronics, with the exception of an audio power amplifier, can be on one ASIC or gate array chip thereby reducing component and manufacturing costs.

It is still a further object of the present invention to provide an entertainment system for storage and playback of audio signals wherein the processing speed stored data can be tailored for the media content without special circuitry or controls.

It is yet a further object of the present invention to provide an entertainment system for storage and playback of audio data including a unique clocking oscillator circuit to provide for all timing and control signals for the entire operation of the system than one small circuit at a minimal cost.

These and other objects and advantages will be more readily apparent to those skilled in the art with reference to the following detailed description and drawings.

BRIEF DESCRIPTION OF THE DRAWINGS

For a fuller understanding of the nature of the present invention, reference should be had to the following detailed description taken in connection with the accompanying drawings in which.

Like reference symbols refer to like parts and features throughout the several views of the drawings.

DETAILED DESCRIPTION OF THE PREFERRED EMBODIMENT

Figure 1A:
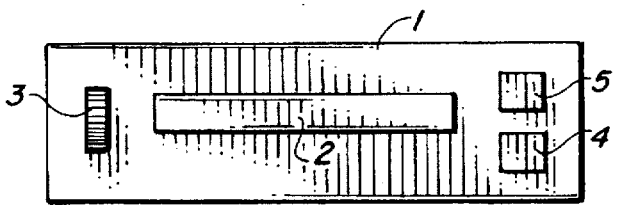
FIG. 1A is a front plan view of a player device of the present invention.
Figure 1B:
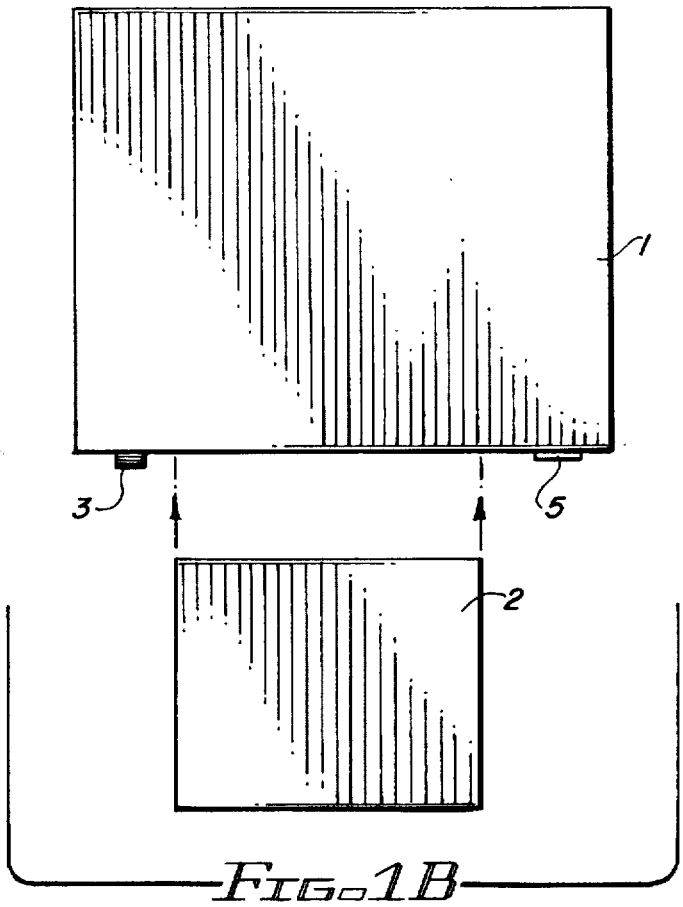
FIG. 1B is a top plan view illustrating insertion of the cartridge into the player device in accordance with the system of the present invention.

Referring initially to FIGS. 1A and 1B, the system of the present invention includes a player device 1 which includes a front panel having a slot therein to accommodate a media cartridge 2. The cartridge 2 is designed so as to allow insertion only in one direction to thereby ensure correct polarization. The front panel of the player 1 provided with an on/off switch (not shown), a volume level control 3, a reset button 4, and a pause button 5. The reset switch 4 and pause switch 5 are preferably of a push button type switch. The reset switch 4, when depressed, starts the program material stored on the cartridge 2 from the beginning of the material programmed thereon. Activation of the pause switch 5 places the system in a pause mode. Upon subsequent depression of the pause switch 5, to release the switch, the system resumes play at the point at which the system was when the pause switch 5 was initially activated.

Figures 2, 3:
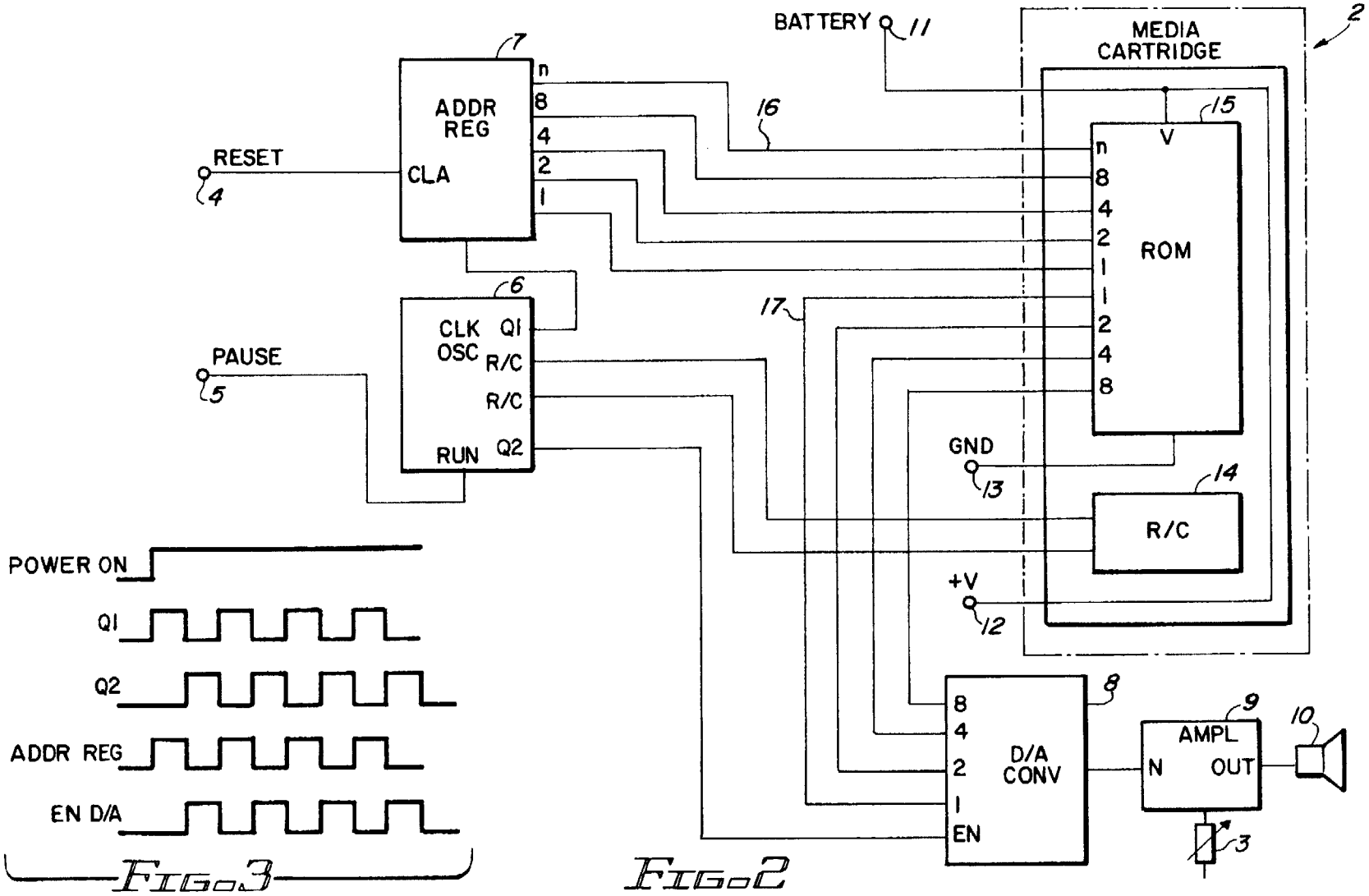
FIG. 2 is a schematic diagram of the sound storage and playback system of the present invention.
FIG. 3 is a timing diagram of the system.

Referring to FIG. 2, a schematic representation of the system is depicted. The components of the player device 1 and the media cartridge 2 are shown in functional relationship in FIG. 2.

Power is supplied to the system via the battery 11 and is routed through the media cartridge 2 to furnish power to the ROM 15. The current flow exits the media cartridge 2 to apply power to the circuitry of the player device 1 via the positive voltage line 12. This routing of the power serves to remove the power from the player device 1 when the media cartridge 2 is removed from the device 1, so as to conserve the battery life if the player device 1 is inadvertently left in the on condition.

Upon application of power to the system, a two phase clocking oscillator 6 provides a clock pulse to the address register 7 via output Q1. The initial or first address is 0000 when power is first applied to activate the system. The clock pulse, generated by the clocking oscillator 6, will increment the address register 7 to the next successive address 0001 for further application to the address bus 16 which is connected to the address input of the ROM 15 within the media cartridge 2. The contents of the ROM 15 address 0001 are then applied to the data bus 17. This data is directed to the input of the digital to analog (D/A) converter 8.

In time, the Q1 output of the clocking oscillator 6 will go inactive based on the value of the resistor/capacitor (R/C) components 14 contained in the media cartridge 2. Q1 of the clocking oscillator 6, going inactive, will cause Q2 of the clocking oscillator 6 to go active. This causes activation of the enable (EN) input of the D/A converter 8. Thereafter, the digital to analog conversion of the analog signal is completed and directed to the output (OUT) of the D/A converter 8. The analog signal is then applied to the input of the audio amplifier 9 for amplification and further application to a listening device 10. The listening volume level is controlled via a control 3 which controls the gain of the audio amplifier 9.

After a predetermined time period, the Q2 output of the clocking oscillator 6 will go inactive based on the value of the R/C components 14 contained in the media cartridge 2. By providing specific R/C values in the media cartridge 2, the ability to conserve ROM 15 can be regulated based on the complexity of the content of the material stored in ROM. For instance, if the content were based on voice audio data, such as encountered in motivational materials, educational materials, or other narrated audio, the bandwidth required would be within the approximate range of 300 Hz to 3000 Hz. Under these conditions, the clocking speed could be relatively low, resulting in an extended playing time. For more complex audio content, such as high fidelity music playback, a higher clocking speed is required. To meet these conditions, the R/C values of the R/C components 14 are selected during manufacture of the cartridge 2 based on the subject audio data stored on the ROM 14. The variable clocking rate is thus fixed for each media cartridge 2 and no circuitry, switching or adjustments are required in the player device 1.

When the Q2 output of the clocking oscillator 6 goes inactive, the Q1 output of the clocking oscillator 6 goes active and the process is repeated so that the address register 7 is incremented to the next successive address 0002. This process continues until address nnnn, the highest address in the address register 7, is reached. At this time, the address register 7 rolls over and the beginning address 0000 is reached, so that the program material stored on the ROM is repeated. In this manner, a continuous loop is achieved, whereby the stored audio material is continually played until the system is interrupted or power is turned off.

The operation of the system can be interrupted or paused by activation of the pause switch 5. Depressing the pause switch 5, to activate the pause mode, serves to hold off the clocking oscillator 6 which in turn halts the incrementing process of the address register 7. Operation is resumed by depressing the pause switch again, to release the switch, thereby allowing the clocking oscillator 6 to resume. Return to the start of the program material stored in ROM 15 can be accomplished by activation of the reset switch 4 which forces a reset of the address register 7 to the beginning address 0000. Power off is accomplished by rotating the volume level control 3 to the minimum position at which the switch, connected mechanically to the volume level control, opens the circuit between the battery and the circuitry. Removal of the media cartridge 2 will also power the system down by breaking the power circuit, as described above.

Figure 4:
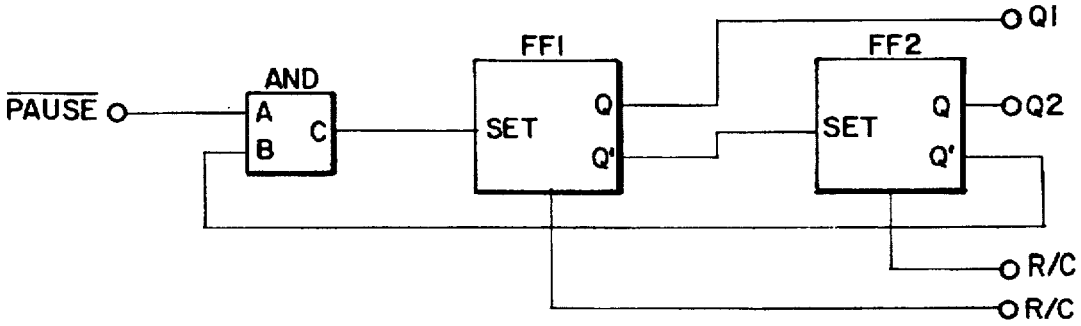
FIG. 4 is a schematic diagram of the clocking oscillator circuit in accordance with the timing means of the system of the present invention.

Referring to FIG. 3, a timing diagram depicts the timing of the system. FIG. 4 illustrates the circuitry utilized to create the timing signals of the system. In referring to the timing diagram of FIG. 3 and the clocking oscillator schematic diagram of FIG. 4, it can be seen that the application of power to the system will bring flip-flop 1 (FF1) up in the active state due to flip-flop 2 (FF2) being in the inactive state with FF2 Q' being true or high and Pause' being true or high, and with the AND gate inputs A and B conditioned and the output C being true or high. These conditions set FF1 active via the SET input. With FF1 active, the FF1 output Q is high or true. This signal from output Q provides the logic level to increment the address register 7 to the next successive address.

When FF1 has been active for the duration, as determined by the value of the R/C elements in the media cartridge, FF1 times out and the output Q goes low. This results in FF1 output Q' going high or active. The FF1 Q' output, when in a high or active state, conditions the SET input of FF2. This causes FF2 to go into an active state with the FF2 Q output going high and the FF2 Q' output going low. When the FF2 Q' output goes low, the B input of the AND gate is de-conditioned to thereby prevent PAUSE switch signal from stopping the system while the digital to analog conversion process is taking place. The FF2 Q output provides the signal for ENABLE D/A as depicted in FIG. 3.

When FF2 has been active for a predetermined period of time, as set by the value of the R/C elements in the media cartridge, FF2 times out and the Q' output of FF2 goes to a high or active state. This conditions the AND gate B input which, in turn, sets FF1 active via the AND gate C output and the FF1 SET input. This starts the cycle all over again as the address register increments to the next successive address.

While not shown in the timing diagram, the R/C values in the media cartridge have the ability to, and actual practice do, control the symmetry of the output signals of FF1 and FF2.

While the instant invention has been shown and described in what is considered to be a preferred and practical embodiment thereof, it is recognized that departures may be made within the spirit and scope of the present invention which, therefore, should not be limited except as defined in the following claims as interpreted under the doctrine of equivalents.

Now that the invention has been described.

What is claimed is:

1. A sound storage and playback system comprising:

a cartridge having memory means for storing digital data therein in accordance with a plurality of corresponding addresses, a player device including:

address register means communicating with said memory means for identifying and actuating one of said plurality of addresses, a digital to analog converter for converting said digital data to analog signals, a data bus for delivering said digital data from said activated one of said plurality of addresses to said digital to analog converter, amplifier means for receiving and amplifying said analog signals, and a timing circuit for controlling alternating actuation of said address register means and said digital to analog converter, said timing circuit further incrementing said address register means to identify and activate a next sequential one of said addresses on said memory means, and said timing circuit including a resistor/capacitor within said cartridge and a clocking oscillator in said slaver device communicating with said resistor/capacitor, said resistor/capacitor being structured to generate predetermined values to control operation of said clocking oscillator.

2. A sound storage and playback system as recited in claim 1 wherein said memory means is read-only memory.

3. A sound storage and playback system comprising:

a cartridge having read-only memory means therein for storing digital data in accordance with a plurality of corresponding addresses, a player device including:

address register means communicating with said read-only memory means for identifying and actuating one of said plurality of addresses, a digital to analog converter for converting said digital data to analog signals, a data bus for delivering said digital data from said activated one of said plurality of addresses to said digital to analog converter, amplifier means for receiving and amplifying said analog signals, and a timing circuit including a resistor/capacitor within said cartridge structured to generate predetermined values and a clocking oscillator operable in response to said generated predetermined values for controlling alternating actuation of said address register means and said digital to analog converter, said timing circuit being further structured to increment said address register means to identify and activate a next sequential one of said addresses on said read-only memory means.

* * * * *